US005557068A

United States Patent [19]

Chung

[11] Patent Number: 5,557,068

[45] Date of Patent: Sep. 17, 1996

[54] CAPACITIVE COUPLED BNC CONNECTOR

[75] Inventor: Yu-Ping Chung, Hsin Chu, Taiwan

[73] Assignee: D-Link Corporation, Hsin Chu, Taiwan

[21] Appl. No.: 563,455

[22] Filed: Nov. 28, 1995

[51] Int. Cl.[6] ..... H01R 13/66; H01R 13/46

[52] U.S. Cl. ..... 174/59; 439/620

[58] Field of Search ..... 439/620, 62, 93; 333/181–185; 174/52.1, 59; 361/785

[56] References Cited

U.S. PATENT DOCUMENTS 5,145,412 9/1992 Tan et al. ..... 439/620

5,167,536 12/1992 Wang ..... 439/620

*Primary Examiner*—Bot L. Ledynh

*Attorney, Agent, or Firm*—Jacobson, Price, Holman & Stern, PLLC

[57] ABSTRACT

A capacitive coupled BNC connector including an insulative body fastened to a PC board, which is secured to a conductive panel by metal mounting screws, a metal mounting frame fixed to the insulative body and having mounting legs fastened to respective mounting holes on the PC board, a conductive, stepped, cylindrical shell fitted into the longitudinal center through hole to hold a ground terminal and an insulated conductive electric contact, permitting the ground terminal and the conductive electric contact to be respectively welded to the PC board, a metal spring plate fastened to a side opening on the cylindrical shell, a plurality of capacitor elements respectively fastened to respective side slots on the insulative body and stopped between the metal spring plate and the metal mounting frame to filter noises transmitted from the conductive panel.

5 Claims, 6 Drawing Sheets

CAPACITIVE COUPLED BNC CONNECTOR

BACKGROUND OF THE INVENTION

The present invention relates to BNC (bayonet navy connector) connectors, and relates more connection between a PC board printed circuit board and a coaxial cable which uses a metal mounting frame to hold down the capacitor elements in respective side slots on the insulative body of the connector.

A variety of capacitive-coupled BNC connectors for installation in a PC board to connect a coaxial cable have been developed. These connectors commonly use two capacitor elements to protect the interference of outside noises. However, the complicated installation process of the capacitor elements relatively increase the manufacturing cost of the connectors.

SUMMARY OF THE INVENTION

According to one aspect of the present invention, the capacitive coupled BNC connector comprises an insulative body fastened to a PC board, which is secured to a conductive panel by metal mounting screws, a metal mounting frame fixed to the insulative body and having mounting legs fastened to respective mounting holes on the PC board, a conductive, stepped, cylindrical shell fitted into the longitudinal center through hole to hold a ground terminal and an insulated conductive electric contact, permitting the ground terminal and the conductive electric contact to be respectively welded to the PC board, a metal spring plate fastened to a side opening on the cylindrical shell, a plurality of capacitor elements respectively fastened to respective side slots on the insulative body and stopped between the metal spring plate and the metal mounting frame to filter noises transmitted from the conductive panel.

According to another aspect of the present invention, the metal mounting frame has two projecting spring leaves stopped against the conductive panel to transmit noises from the conductive panel to the capacitor elements for filtration.

According to still another aspect of the present invention, the mounting legs of the metal mounting frame are connected to the metal mounting screws by conductors when they are fastened to the respective mounting holes on the PC board, and therefore noises can be transmitted from the conductive panel to the capacitor elements for filtration.

DETAILED DESCRIPTION OF THE PREFERRED EMBODIMENT

Figure 1:
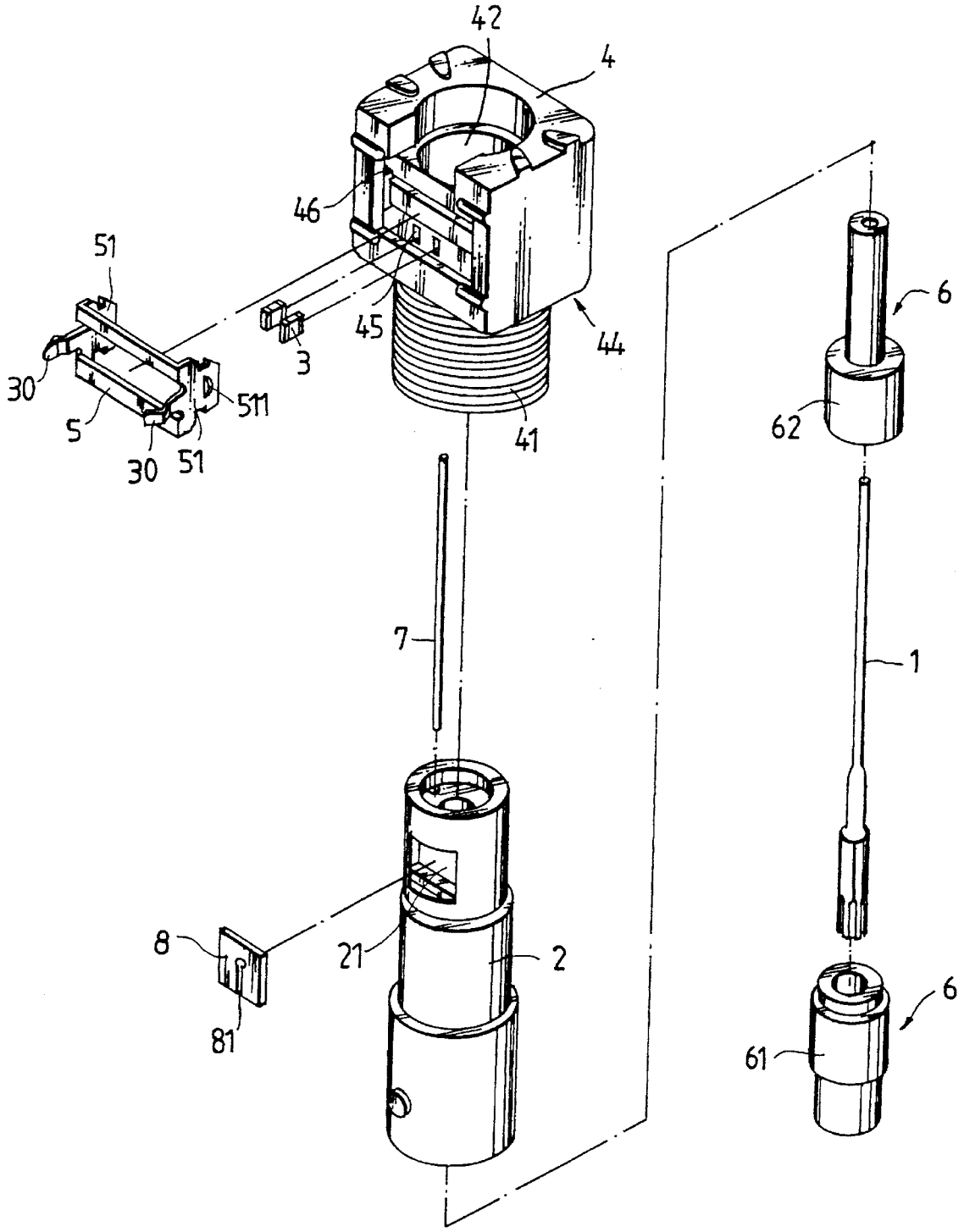
FIG. 1 is an exploded view of a BNC connector according to the present invention.

Referring to FIG. 1, a BNC connector in accordance with the present invention is generally comprised of a conductive electric contact 1, a conductive, stepped, cylindrical shell 2, two capacitor elements 3, an insulative body 4, a metal mounting frame 5, an insulative, stepped, cylindrical terminal holder 6, a ground terminal 7, and metal spring plate 8. The conductive electric contact 1, known as a center contact, is mounted in the terminal holder 6. The terminal holder 6 is comprised of two sockets 61 and 62 axially connected together, and mounted within the shell 2. The ground terminal 7 is mounted inside the shell 2 in parallel to the conductive electric contact 1. The shell 2 has a side opening 21. The metal spring plate 8 is mounted within the side opening 21 of the shell 2, having at least one split 81. The insulative body 4 comprises a threaded, cylindrical coupling portion 41 at one end, a longitudinal center through hole 42, which snugly receives the shell 2, two hoks 46 and two side slots 45 disposed at one side in a parallel relation. The capacitor elements 3 are respectively mounted in the side slots 45 of the insulative body 4. The metal mounting frame 5 comprises two end strips 51 perpendicularly and forwardly extending from two opposite ends thereof for insertion into a respective hole 46 on the insulative body 4, two hooked portions 511 respectively raised from each end strip 51 at an outer side, and two mounting legs 30 perpendicularly and backwardly extending from the opposite ends. The metal mounting frame 5 is fastened to the insulative body 4 on the outside by the hooked portions 511 to hold down the capacitor elements 3 in the side slots 45 of the insulative body 4.

Figure 2:
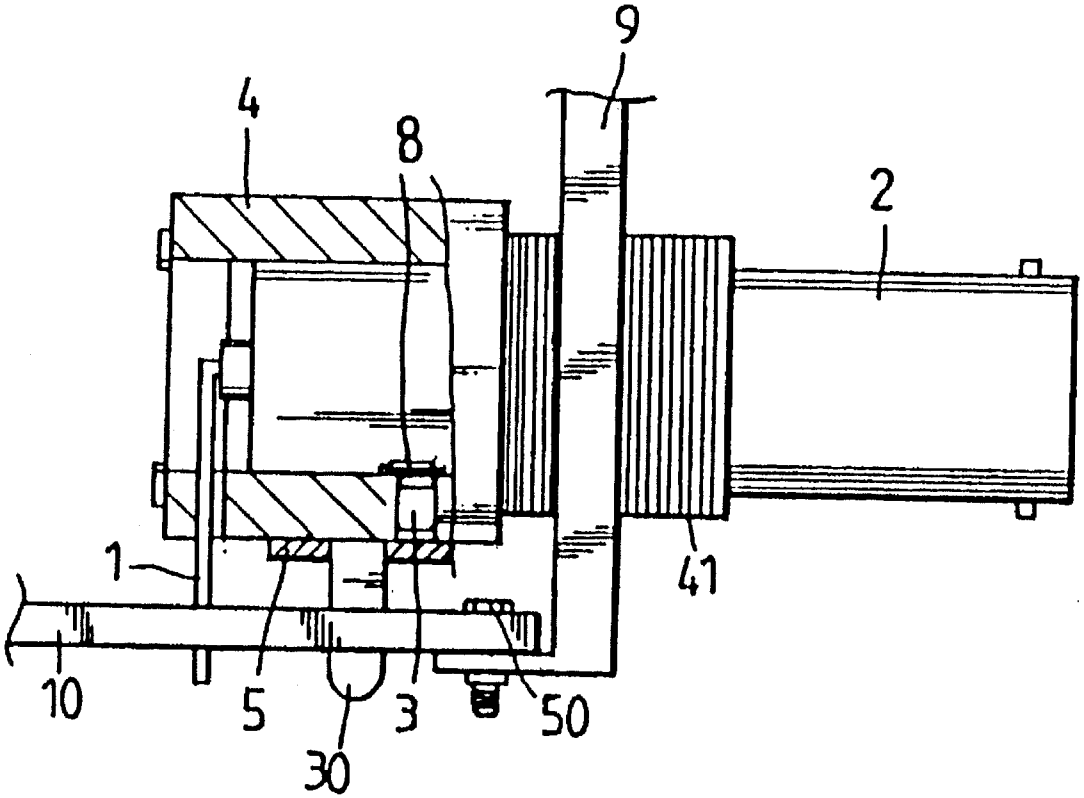
FIG. 2 is a sectional assembly view of the BNC connector shown in FIG. 1.
Figure 3:
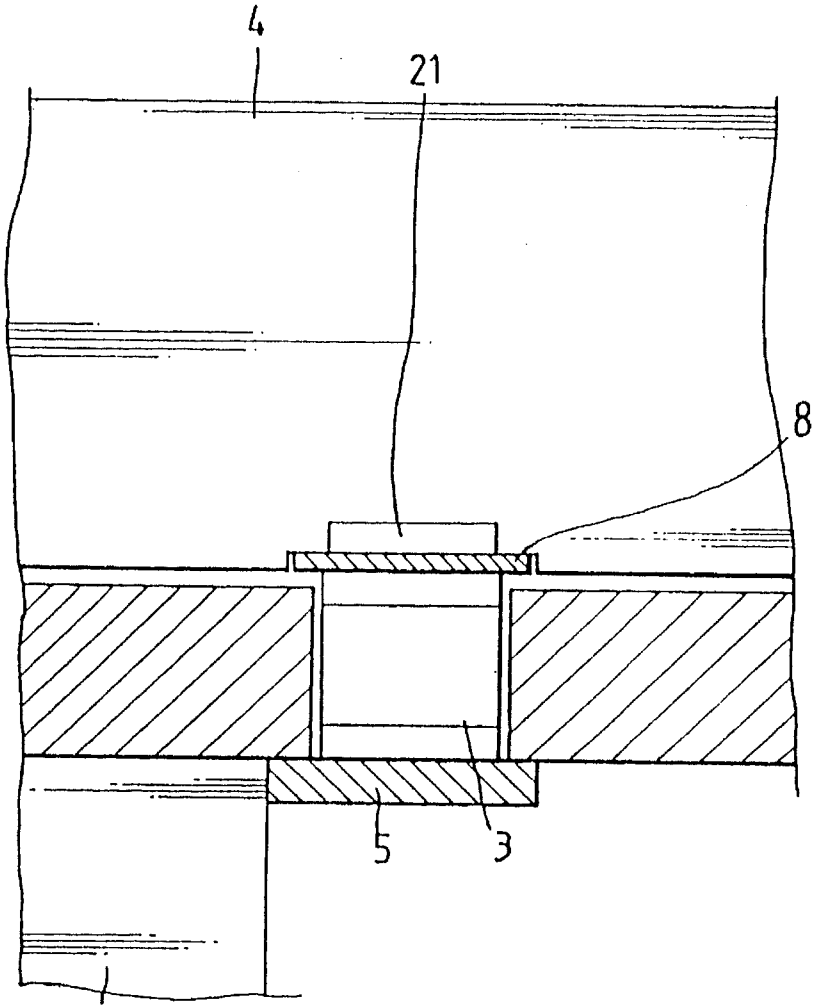
FIG. 3 is a partial view in section in an enlarged scale of FIG. 2, showing the positions of the capacitor elements relative to the metal mounting frame and the metal spring plate.
Figure 4:
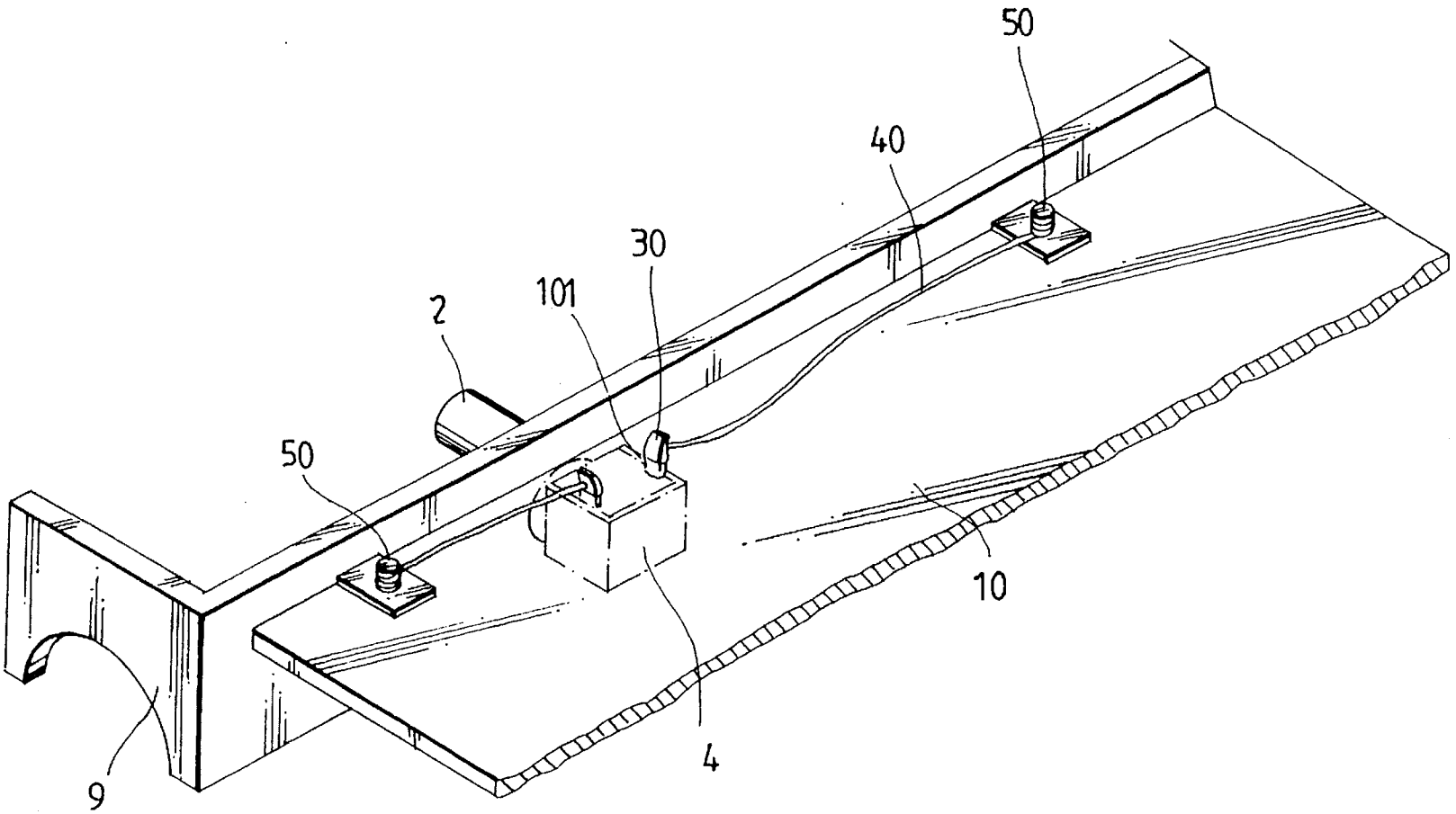
FIG. 4 is an applied view of the present invention, showing the BNC connector installed in the PC board, and the mounting legs of the metal mounting frame connected to the conductive panel.

Referring to FIGS. 2 and 3, and FIG. 1 again, the threaded, cylindrical coupling portion 41 of the insulative body 4 is fastened to the conductive panel 9, which is fixedly secured to the PC board 10 at right angles, thee conductive electric contact 1 and the ground terminal 7 are respectively welded to the PC board 10. The two capacitor elements 3 are respectively mounted within the side slots 45 of the insulative body 4, each having one end stopped at the metal spring plate 8 and an opposite end stopped at the metal mounting frame 5. When installed, the two capacitor elements 3 are disposed at two opposite sides relative to the split 81. Referring also to FIG. 4, the mounting legs 30 are respectively fastened to a respective mounting hole 101 on the PC board 10, and then connected to a respective metal mounting screw 50, which secures the conductive panel 9 to the PC board 10, by a respective conductor 40. Therefore noises induced from the conductive panel 9 will be transmitted through the conductors 40 and the mounting legs 30 to the capacitor elements 3, and then filtered by the capacitor elements 3. Because the capacitor elements 3 are directly inserted into the side slots 45 of the insulative body 4 and then secured in place by the metal mounting frame 5, the installation procedure of the capacitor elements 3 is easy. Because the capacitor elements 3 are stopped at the metal spring plate 8 at two opposite sides relative to the split 81, the split metal spring plate 8 absorbs compression force during the assembly process of the BNC connector, to prevent a damage to the capacitor elements 3.

Figure 5:
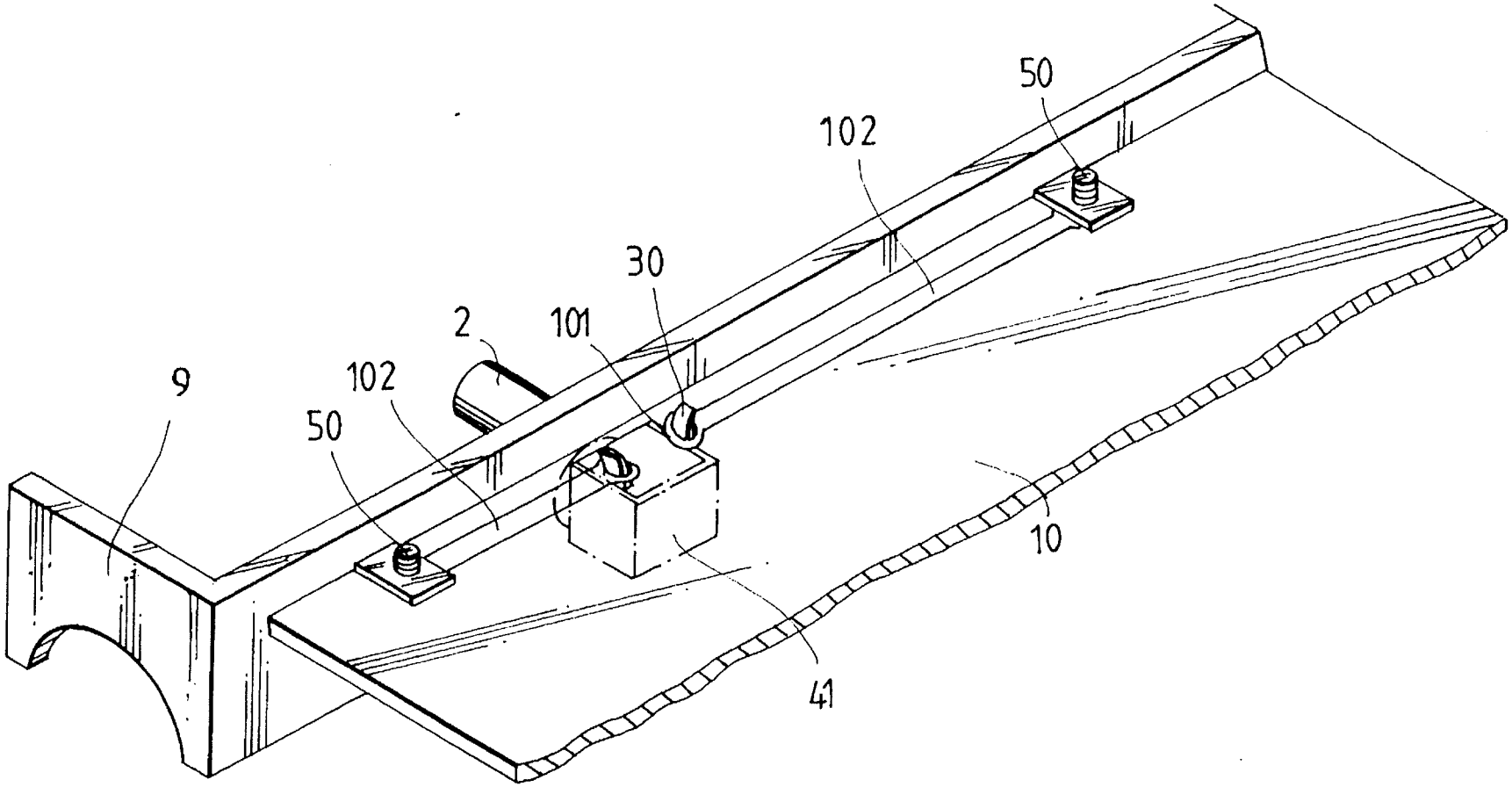
FIG. 5 shows an alternate mounting method of the present invention.

Referring to FIG. 5, the circuit 102 of the PC board 10 is connected to the mounting screws 50 and the mounting holes 101, therefore the capacitor elements 3 are connected to the conductive panel 9 when the mounting legs 30 of the metal mounting frame 5 are respectively forced into the mounting holes 101. This arrangement eliminates the installation of the aforesaid conductors 40.

Figure 6:
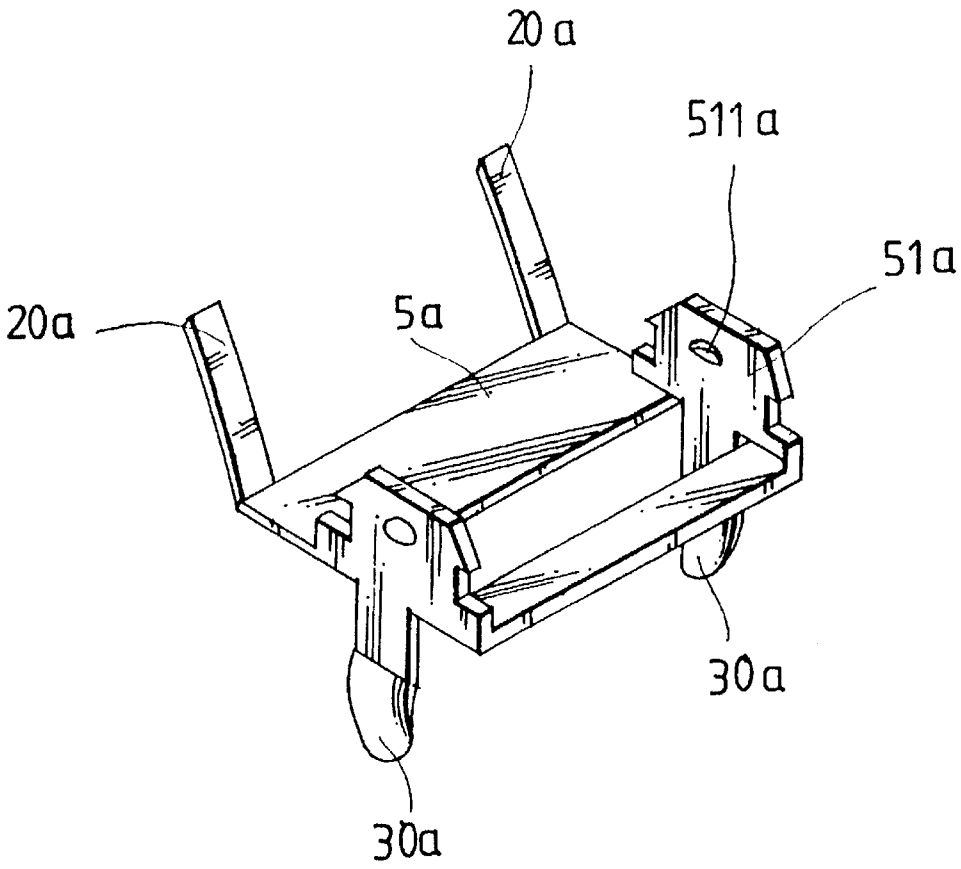
FIG. 6 shows an alternate form of the metal mounting frame according to the present invention.

FIG. 6 shows an alternate form of the metal mounting frame 5*a*. According to this alternate form, the metal mounting frame 5*a* has two projecting spring leaves 20*a* raised from one side. When the metal mounting frame 5*a* is fastened to one lateral side 44 (see also FIG. 1) and the mounting legs 30*a* are respectively forced into the respective mounting holes 101 of the PC board 10, the projecting spring leaves 20*a* are respectively stopped against the conductive panel 9 to transmit noises from the conductive panel 9 to the capacitor elements 3 for filtration.

It is to be understood that the drawings are designed for purposes of illustration only, and are not intended as a definition of the limits and scope of the invention disclosed.

I claim:

1. A BNC connector comprising:

an insulative body having a threaded, cylindrical coupling portion at one end fastened to a conductive panel, a longitudinal center through hole, a plurality of mounting holes and a plurality of side slots at a bottom side thereof;

a metal mounting frame secured to said insulative body, said metal mounting frame comprising a plurality of end strips respectively inserted into the mounting holes of said insulative body, a plurality of hooked portions respectively raised from said end strips and hooked in the mounting holes of said insulative body, and a plurality of mounting legs respectively fastened to a respective mounting hole on a PC board;

a conductive, stepped, cylindrical shell fitted into the longitudinal center through hole to hold a ground terminal and a conductive electric contact, permitting said ground terminal and said conductive electric contact to be respectively welded to said PC board, said cylindrical shell having a metal spring plate fastened to a side opening thereof;

a plurality of capacitor elements respectively fastened to the side slots of said insulative body and stopped between said metal spring plate and said metal mounting frame to filter noises transmitted from said conductive panel; and an insulative socket mounted within said cylindrical shell to insulate said conductive electric contact from said cylindrical shell.

2. The BNC connector of claim 1 wherein the mounting legs of said metal mounting frame are connected to metal mounting screws by a respective conductor.

3. The BNC connector of claim 1 wherein the electric circuit of said PC board extends to the mounting holes thereof and metal mounting screws, so that said capacitor elements are electrically connected to said metal mounting screws and said conductive panel through said metal mounting frame when the mounting legs of said metal mounting frame are respectively fitted into the mounting holes of said PC board.

4. The BNC connector of claim 1 wherein said metal mounting frame has two projecting spring leaves stopped against said conductive panel.

5. The BNC connector of claim 1 wherein said metal spring plate of said cylindrical shell has at least one split disposed between said capacitor elements.

* * * * *